US005661299A

United States Patent [19]

Purser

[11] Patent Number: 5,661,299

[45] Date of Patent: Aug. 26, 1997

[54] MINIATURE AMS DETECTOR FOR ULTRASENSITIVE DETECTION OF INDIVIDUAL CARBON-14 AND TRITIUM ATOMS

[75] Inventor: Kenneth H. Purser, Lexington, Mass.

[73] Assignee: High Voltage Engineering Europa B.V., Netherlands

[21] Appl. No.: 668,297

[22] Filed: Jun. 25, 1996

[51] Int. Cl.[6] ..... H01J 49/28

[52] U.S. Cl. ..... 250/281; 250/282

[58] Field of Search ..... 250/281, 282

[56] References Cited

U.S. PATENT DOCUMENTS

| | | | |
|---|---|---|---|
| 4,037,100 | 7/1977 | Purser | 250/281 |
| 4,067,702 | 1/1978 | Hickman | 250/281 |
| 4,489,237 | 12/1984 | Litherland et al. | 250/282 |
| 5,569,915 | 10/1996 | Purser et al. | 250/281 |

OTHER PUBLICATIONS

Science, vol. 236; May 1987; pp. 543–550; David Elmore and Fred Phillips; "Accelerator Mass Spectrometry for Measurement of Long–Lived Radioisotopes".

Postlabelling Methods for Detection of DNA Adducts Ed. D.H. Phillips, M. Castegnaro & H. Bartsch Lyon, International Agency for Research on Cancer IARC, 1993 pp. 293–301; K.W. Turteltaub, et al. "Studies on DNA Adduction . . . ".

Nuclear Instruments and Methods in Physics Research B5 (1984) 254–258; "Hansjakob Hofmann, et al.; Charge State Distributions and Resulting Isotopic Fractionation Effects of Carbon and Chlorine in the 1–7 MeV Energy Range".

Nuclear Instruments and Methods in Physics Research B 99 (1995) 98–100; "F. Melchert, et al.; Neutralization of H beams in 'plasma–neutralizers'".

ATOMIC Data 5, 113–166 (1973); A. B. Wittkower, et al.; "Equilibrium–Charge–State Distributions of Energetic Ions (z>2) in Gaseous and Solid Media".

*Primary Examiner*—Jack I. Berman
*Attorney, Agent, or Firm*—Nields & Lemack

[57] ABSTRACT

Accelerator mass spectrometry (AMS) demonstrates more than a million times greater sensitivity for $^{14}C$ atoms and a thousand times greater sensitivity for tritium atoms than is possible using classical beta particle detection. This improved sensitivity can be used to help understand the role that chemical pollutants at ambient concentrations play in metabolic processes and in initiating mutations. Such measurements are critical to understanding many biomedical processes and establishing relevant environmental regulations. The present invention comprehends a device that can be used for the direct detection of either carbon-14 or tritium atoms. Unique features are that the highest acceleration voltage needed is only about 200 kilovolts and that vacuum insulation can be used to provide the necessary electrical insulation, rather than the high pressure sulfur hexafluoride gas, that is a characteristic of most electrostatic accelerators.

13 Claims, 3 Drawing Sheets

MINIATURE AMS DETECTOR FOR ULTRASENSITIVE DETECTION OF INDIVIDUAL CARBON-14 AND TRITIUM ATOMS

FIELD OF THE INVENTION

Interactions between biomolecules and natural or man-made chemicals can have important biological consequences at very low concentrations. Many effects occur at concentrations between $10^{-12}$ and $10^{-9}$. During experiments to understand such processes, it is common analytical practice to use chromatographic procedures to provide chemical separations. Often the yield of an individual separate may contain only micrograms or less of the chromatographically defined material. Thus, quantities having mass in the range $10^{-18}$–$10^{-15}$ grams must be measurable.

One method of achieving such sensitivities is to attach identifiable labels to the molecules or ligands of interest. Such labeling allows metabolic processes to be followed from one step to another by tracking the location of these labels. When this is done, attomole to zeptomole sensitivity can be achieved if the label can be detected with modest efficiency (0.1%–1%).

Disintegrating radioisotopes can provide excellent tags. Interfering backgrounds are often close to zero and when the radioisotope decays the energy released is enormous compared to thermal energies making possible detection techniques having excellent signal-to-noise ratio. The radioisotopes, $^{14}C$ and tritium are unique as such tagging labels, in as much as they can be substituted for carbon atoms and tritium within organic compounds with little or no change in the physical or chemical properties of the compound. Unfortunately, however, the half-life of $^{14}C$ (5730 years) is very long for conventional tagging purposes and thus the counting rate is low. When radioactive decay must be used for $^{14}C$ detection it is barely possible to detect five femtomoles ($5\times10^{-15}$ moles) of $^{14}C$ in an ideal sample.

During the last 18 years the development of accelerator mass spectrometry (AMS) has made possible the elimination of this detection limitation allowing C-14 tags to be applied to solve many significant problems where ultra-sensitivity is needed. In contrast to classical radioactive decay procedures, AMS directly counts the number of $^{14}C$ atoms within a sample without any reference to C-14's radioactive decay. Such single atom measurements can be quite efficient and, because nuclear disintegration is not involved, it is not necessary to wait for the decay of an atom to recognize its presence. For both tritium and $^{14}C$, the efficiency of tag detection is enormously improved using AMS. Demonstrated AMS enhancement factors (defined as the ratio of AMS/Radioactive sensitivities) are in the order $10^6$ for $^{14}C$ and $10^3$ for $^3H$ assuming counting times of about one hour.

Because of widespread interest in applying such sensitivity, pressures are growing for the development of laboratory sized instruments. The present specification describes a small sized AMS system for $^{14}C$ and tritium that does not require the use of million volt technology. The maximum voltages in this system will be only 150 kilovolts, a value that can be easily sustained in air or high vacuum using proper voltage division. High vacuum is particularly attractive as it allows compact construction and avoids the use of high pressure insulating gas. In addition, using high vacuum insulation, pumping of gas molecules from the acceleration stages and the stripper region is greatly improved and access for maintenance is simplified.

SUMMARY

This invention comprehends a device that can be used for the direct detection of either carbon-14 or tritium atoms. The highest acceleration voltage needed is only about 200 kilovolts and vacuum insulation can be used to provide the necessary electrical insulation, rather than the high pressure sulfur hexafluoride gas that is a characteristic of most electrostatic accelerators.

BRIEF DESCRIPTION OF THE DRAWINGS

The invention may best be understood from the following detailed description, thereof, having reference to the drawings in which.

DESCRIPTION OF THE PRIOR ART

Figure 1:
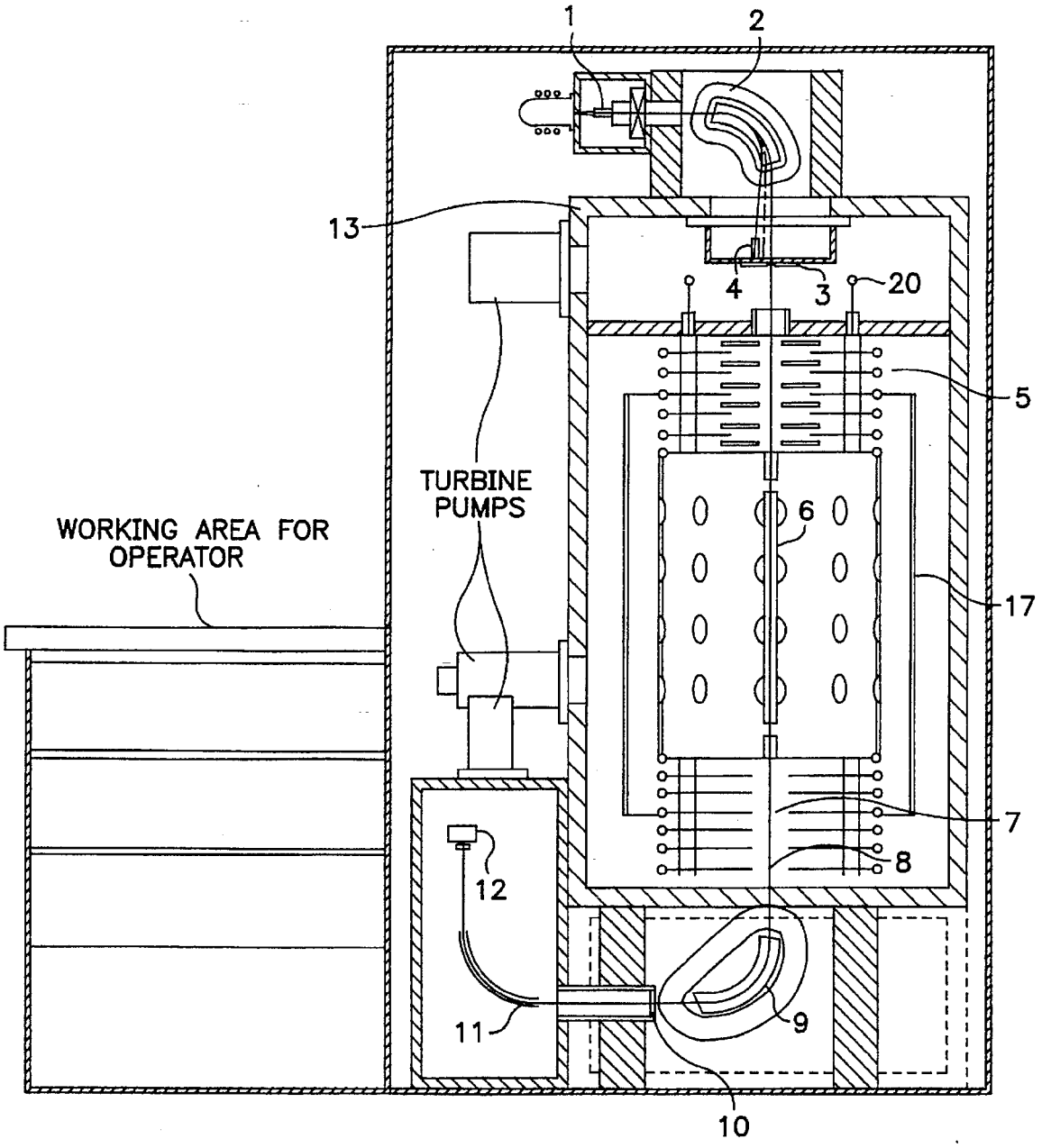
FIG. 1 is a diagram showing the principle of the preferred embodiment.

Carbon-14, a radioactive isotope of the element carbon, decays to nitrogen-14 with a half life of 5730 years. Tritium, an isotope of hydrogen, has a half life of 12.3 years decaying to $^3He$.

Both species are often employed as tracers by adding C-14 or tritium in specific molecular locations to compounds allowing tracking of the path and progress of physical and chemical processes.

During the last seventeen years, a revolution has taken place in the detection of C-14 atoms; the classical C-14 detection procedure, which depends upon detecting individual C-14 atoms from observation of their nuclear decay, has been partly superseded by the AMS technique. Here, C-14 atoms are, detected directly by mass spectrometric means rather than waiting for the associated radioactive decay. Because the decay rate of a C-14 atom is so slow (mean life of a C-14 atom is 8268 years), the sensitivity for detecting C-14 atoms can be enhanced by five or six orders of magnitude using AMS. It is possible to measure within 100 microgram carbon samples, $^{14}C/^{12}C$ isotope ratios of $10^{-15}$ and below; this corresponds to $^{14}C$ concentrations that are 1/1000 that found in the biosphere. Examples of the potential applications of the use of C-14 as ultra-sensitive tags in biomedicine have been recently reviewed by K. W. Turteltaub, J. S. Vogel, C. E. Frantz and F. Fultz in *Post Labeling Methods of DNA Adducts* Phillips, D. H., Castegnaro, M. and Bartsch, H. (eds.) IARC, Lyon, pp 293, (1993). These workers have demonstrated chemical detection limits below attomole concentrations ($10^{-18}$ mole).

The basic principles of AMS have been described by K. H. Purser in U.S. Pat. No. 4,037,100 and by D. Elmore and F. M. Phillips in Science, 236, (1987), 543–550. Here, it is pointed out that a major limitation of conventional mass spectrometry arises from interferences by molecules having almost the same Weight as that of the wanted atoms. Using AMS procedures such background molecules can be eliminated with 100% certainty. This elimination of molecular backgrounds entails directing high velocity wanted atoms plus background molecules through a thin foil or gas volume. During the succeeding atomic collisions several valency electrons are stripped away from each atom and molecule. Losing electrons induces a loss of molecular binding and allows the unbalanced internal Coulomb forces to fragment the molecule. While almost all molecules having a positive charge greater than $2^+$ become unbound and quickly fragment into smaller components, atoms are not affected. Thus, if the stripper foil or gas cell is followed by a charge analysis stage that transmits only those ions having a charge state of $3^+$ or higher, only atoms will be transmitted and all molecular fragments can be rejected.

In an article by H. Hoffman, G. Bonnani, E. Morenzoni, M. Nessi, M. Suter, and W. Wolfli, found in Nuclear Instruments and Methods B5, (1984), pg. 254, equilibrium distributions are presented for carbon ions when they are stripped in foil or gas. These curves show that when using gas for electron stripping show energies of 3 MeV are necessary to achieve a peak in the yield of 3+ ions; for thick carbon foils, the corresponding energy is about 2.2 MeV. Thus, using the accelerator geometry described in the above U.S. Pat. No. 4,073,100, terminal voltages between 2 and 3 million volts are essential for maximizing yield and achieving high statistical accuracy. As a consequence, in all operating C-14 systems, the final ion energy has been 10 MeV or higher, requiring large deflection radii electrostatic deflectors and heavy magnets.

In the present invention, compactness is achieved by stripping electrons from ions in the energy range 150 keV to 300 keV. Helium gas produces the highest yield and for energies of 170 keV, the yield of $^{14}C^{3+}$ ions is about a factor of fifteen lower than that achievable using conventional geometries at the optimum stripping energy of 3 MeV. Although the overall C-14 sensitivity of this new device is lower than that of the multi-megavolt AMS systems described above, the signal to natural background only deteriorates by a factor of four. The advantages of reduced size and lower cost make such an apparatus attractive for many applications that do not require the ultimate in sensitivity or accuracy.

A. B. Wittkower and H. D. Betz in Atomic Data, 5, (1973), 113–166 present measured data that for the equilibrium charge changing efficiencies of carbon ions in several gases. The relevant equilibrium yields for helium are presented in Table I below.

TABLE I

| Chosen Ion Energy | Fraction of ions in the 3+ charge state |
|---|---|
| 0.144 MeV | 1.2% |
| 0.193 | 2.4 |
| 0.243 | 3.3 |
| 0.292 | 4.2 |

The Proposed Instrument

FIG. 1 shows the principles of the preferred embodiment of the instrument that applies these concepts. The stages of analysis and acceleration follow:

1) A production region (1) where negative carbon or tritium ions are produced with an energy of approximately 20 keV. Although any method for generating a suitable $C^-$ ion beam may be used, in the preferred embodiment, $C^-$ ions would be directly derived from carbon dioxide combusted from the sample being measured. Negative tritium ions can also be produced in many ways. The preferred embodiment for tritium would be from hydrogen or water bled into the source. This production region (1) may be referred to as the "ion source 1".
2) A mass analysis region (2) designed to transmit through the first defining slit (3) only those ions having a mass of 14 AMU (for carbon-14) or mass of 3 AMU (for tritium). A Faraday cup (4) is included for measuring the C-12 and hydrogen currents needed for normalization. This mass analysis region (2) may be referred to as the "negative ion analyzer 2". The first defining slit (3) may be referred to as the "mass defining aperture 3", and the Faraday cup (4) may be referred to as the "mass 1 or 12 collector 4".
3) A region (5) where the previously selected ions are further accelerated through a potential of 150 kV to an energy 170 keV. It can be seen from Table I that while the value of this energy is not critical, higher energies improve the yield. Voltages up to 200 kV can be readily insulated in air or vacuum so that the use of an acceleration voltage below this level is practical. This region (5) may be referred to as the "power supply and acceleration section 5".
4) The above 170 keV ions are directed through a windowless helium gas cell (6) having an integrated thickness of approximately 50 micron. cm. Here, approximately 2% of the above selected mass-14 ions lose 4 electrons and the $^{14}C$ ions are converted to the $^{14}C^{3+}$ state. For tritium, approximately 85% of the incident $T^-$ ions are transferred to $T^+$. This helium gas cell (6) may be referred to as the "terminal stripping canal 6".
5) The above positive ions, together with all other atoms and molecular fragments, reenter the acceleration electric field (7) and are repelled from the terminal to ground through the above 150 kV potential. The energy gain of the positive $^{14}C^{3+}$ ions is an additional 450 keV and thus they leave the accelerator section with a total kinetic energy of 620 keV. For tritons, the positive ion charge can only be 1+ and these ions leave the acceleration section at the exit point 8 with a final energy of 320 keV. This acceleration electric field (7) may be referred to as the "positive ion stage 7".
6) In the preferred embodiment shown in FIG. 1, the post acceleration mass analysis stage consists of a 90° magnetic deflection element (9), that eliminates molecular break-up products for both carbon and tritium at the second defining aperture 10. This element is followed by electrostatic analysis (11) which removes any particle that has the wrong energy/charge ratio. The magnetic deflection element (9) may be referred to as an "analysis magnet 9", and the electrostatic analysis (11) may be referred to as an "electrostatic deflector 11".
7) The transmitted particles are finally directed into a suitable detector (12) that provides kinetic energy data for each individual particle independently of its momentum/charge or energy/charge. For tritium ions, the energy must be 320 keV; for $^{14}C$ the energy must be 620 keV. All other energies indicate unwanted background particles that are rejected electronically. The detector (12) may be referred to as a "final detector 12".

Although the above sequence of analysis stages may appear complex, the ion optical transmission and the conversion efficiencies at reach stage can be readily calculated by those skilled in the art. For most stages, the optical transmission efficiency for C-14 or tritium can be close to unity. Efficiency losses occur primarily at the ion source and in stripping. The production efficiency for $C^-$ from $CO_2$ gas is in the range 10–20%. At the high voltage terminal, the fraction of ions that leave in the $3^+$ charge state is approximately 2% (see Table I). Overall, a C-14 collection efficiency of approximately 0.2–0.4% can be anticipated, between $CO_2$ sample and final detector.

C-14 Detection and Ultimate Sensitivity

The ultimate sensitivity involves an estimate of the minimum signal that can be reliably detected in a reasonable counting period above the background of $^{14}C$ naturally present in the sample. This background originates from $^{14}C$ atoms produced in the atmosphere by cosmic rays that enter plants and the food chain by photosynthesis.

From the known $C^-$ current output from a sputter ion source, (the order of 20 microamperes for $^{12}C^-$) the background count rate in the final detector using a non-enriched natural sample will be in the range 2–4 counts per second. Spurious instrument backgrounds will be negligible compared to this rate. In many practical applications an initial chromatography separation may yield a single component of a microgram or less containing traces of some metabolized contribution having a mass of $10^{-18}$ grams. For the purpose of estimating ultimate sensitivity, one can assume that in this organic component the molecules are saturated with C-14 atoms and that there will be of order 50,000 $^{14}C$ in the sample. Using a sample consumption time of one minute and an overall detection efficiency of 0.2%, there would be an integrated C-14 count above background of 100. Thus, in one minute there would be 220 counts from the sample plus background from which 120 must be subtracted as they originate from the natural environmental background. A conservative estimate of the preferred embodiment is that the practical limit to sensitivity for $^{14}C$ will be between 1–10 Attomole.

Tritium Detection and Ultimate Sensitivity

Detection of tritium is favorable using the preferred embodiement. The stage in the above AMS analysis sequence having lowest transmission efficiency is the ion source. It is known that this will be ~2% for $H^-$ production from hydrogen gas in a cusp source. The transport efficiency through the rest of the system will be approximately 0.8 for tritons. The conversion efficiency in the terminal from negative to positive is approximately 85%. Extremely clean spectra will be available from the above final detector because of the large differences in stopping power between tritons and all other potential backgrounds. For a 20 cc/hour flow of molecular hydrogen in which there is a tritium/proton concentration of $1:10^{18}$, it is anticipated that there will be about 20 counts/hour. The background, assuming tritium free source gas, should be virtually zero.

Enhancement of Stripping Yields

F. Melchert, M. Benner, M. Kruedener, E. Salzborn in Nuclear Instruments and Methods in Physics Research, B99, (1995), pages 98–100, present measured data for the electron detachment processes from fast $H^-$ ions when they are directed through a plasma containing a high concentration of multiply charged noble gas ions. Estimates that these authors have made, based on their measurements, indicate that the neutralization efficiency is substantially enhanced when using a plasma over that observed using neutral gas.

It is anticipated that this same effect can be exploited in the terminal stripper of the preferred embodiment during the conversion of negative carbon ions to the positive $3^+$ charge state needed for wanted particles that are allowed to pass to the detector.

By passing the selected mass-14 particles through a plasma it is anticipated that the yield of wanted $3^+$ ions will be enhanced at low energies. To those skilled in the art it will be apparent that the necessary plasma for terminal stripping can be produced in a variety of ways. These include r.f. or microwave excitation, fast electron excitation.

Vacuum Insulation

In the preferred embodiment high vacuum insulation (13) is used for isolating the 150 kV acceleration potential. In FIG. 1, this high vacuum insulation (13) may be referred to as a "high vacuum chest with hinged swing-out door 13". At voltages up to about 200 kV, vacuum insulation is simpler than air or high-pressure gas, and confers important advantages: Firstly, vacuum pumping is greatly improved as gas molecules, exiting from the ends of the stripping canal and from outgassing within the acceleration tube, are pumped radially from the accelerator rather than being forced to travel the length of a small diameter acceleration tube. Secondly, there is no outgassing from glued seals within the accelerator. Thirdly, maintenance is simplified as there is no requirement for an auxiliary high pressure pump and storage system for the insulating gas when the instrument must be opened for maintenance or repair. Fourthly, a pressure vessel, designed and coded to ASME standards for safety and insurance purposes, becomes unnecessary. Finally, high frequency feed-throughs are readily available for vacuum applications; for pressurized gas they must be designed specially and approved to allow ASME coding.

Usable Electric Fields in Vacuum Insulation

While fields of 15 million volts/meter (MV/m) have been applied by researchers using high energy ion deflectors and velocity selectors, such devices employ special surface finish and coatings to minimize the development of whiskers. The use of such procedures is undesirable and the design should be such that the gross electric fields are below 1.5 MV/m (15 kV/cm). Shaping at corners, etc. should be such that the electric fields remain below 2 MV/m. Such a gradient is extremely conservative and should be compared to the electric fields of 1.7–2.0 MV/meter that are used routinely and stably throughout the largest electrostatic tandem accelerators.

Insulator Breakdown

Figure 2:
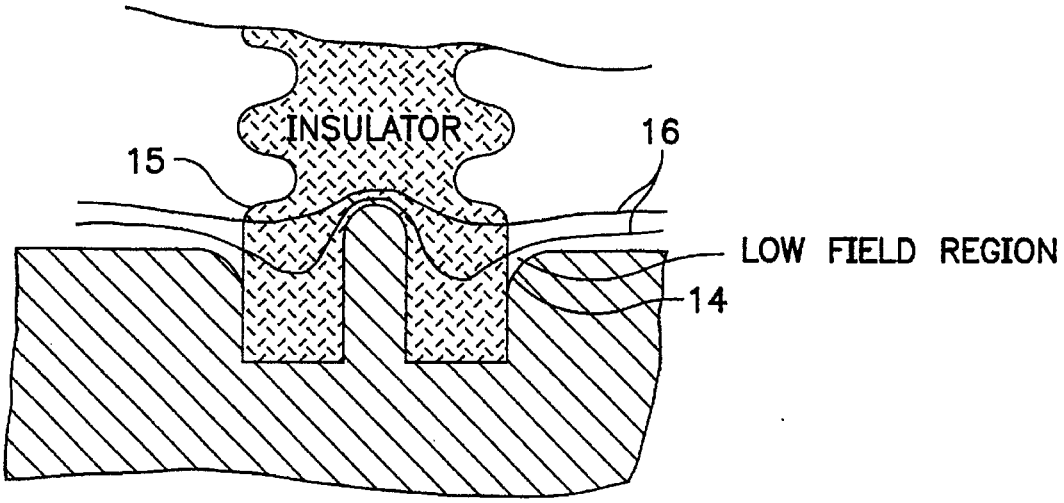
FIG. 2 shows a method of insulator mounting to minimize surface leakage currents.

In vacuum, breakdown occurs on an insulator surface at lower fields than those that cause whisker formation and vaporization of metals. Thus, insulators are the weak point in any high voltage electrostatic accelerator. The triple point where the insulator, vacuum and metal come together is particularly vulnerable. FIG. 2 show the manner in which an insulator can be mounted to minimize leakage currents along the surface. Here, the triple point (14) is in a low-field region. In addition, convolutions (15) around the surface produce regions where the electric field, at right angles to the equipotentials (16), is normal to the insulator surface minimizing the flow of surface currents. Ideally, such an insulator should be slightly tapered (30 degrees) so that any electrons emitted from the negative electrode pass directly to the positive electrode without striking the insulator surface.

Total Voltage Effect

An important aspect of vacuum insulation is the so-called total voltage phenomenon. In this mode, breakdown is related not only to the electric field and growth of whiskers on a metal surface but also to the total voltage between the electrodes. The detailed mechanism is still somewhat obscure but it is accepted that when ions strike an insulating layer on an electrode, both positive and negative secondary particles are produced. Above a critical total voltage between the electrodes, the value of which depends upon materials and surface conditions, the energy of the secondary ions becomes great enough that regenerative flow of positive and negative ions (and possibly electrons) can build up exponentially between the electrodes leading to a microdischarge. In practice, using polished stainless steel or titanium a single gap can reliably hold off between 80–100 kV. In the instrument described here, properly graded, intermediate shields (17) must be employed wherever the total voltage is greater than about 80 kV.

Cooling

While the beam power needed for acceleration is vanishingly small (~$10^{-5}$ Watts for accelerating the expected molecular currents), a small amount of power will be lost due to circulating currents in the capacitors and rectifiers of the power supply. Thus, some cooling is essential. This can be achieved by passing high resistivity water through small diameter polyethylene tubing (18) spiraling along the length of the acceleration stages and the column. At each electrode the water, itself, makes electrical contact allowing the water column to not only provide cooling, but also provide electrostatic grading of the whole assembly plus a continuous measurement of the acceleration voltage. The precise value of the water resistivity is not critical as it will be continuously monitored. A desirable current drain is about 100 microamperes. Using an industrial deionizer, it is easy to maintain the resistivity of water above 5 Megohm.cm.

Voltage Generation

Figure 3:
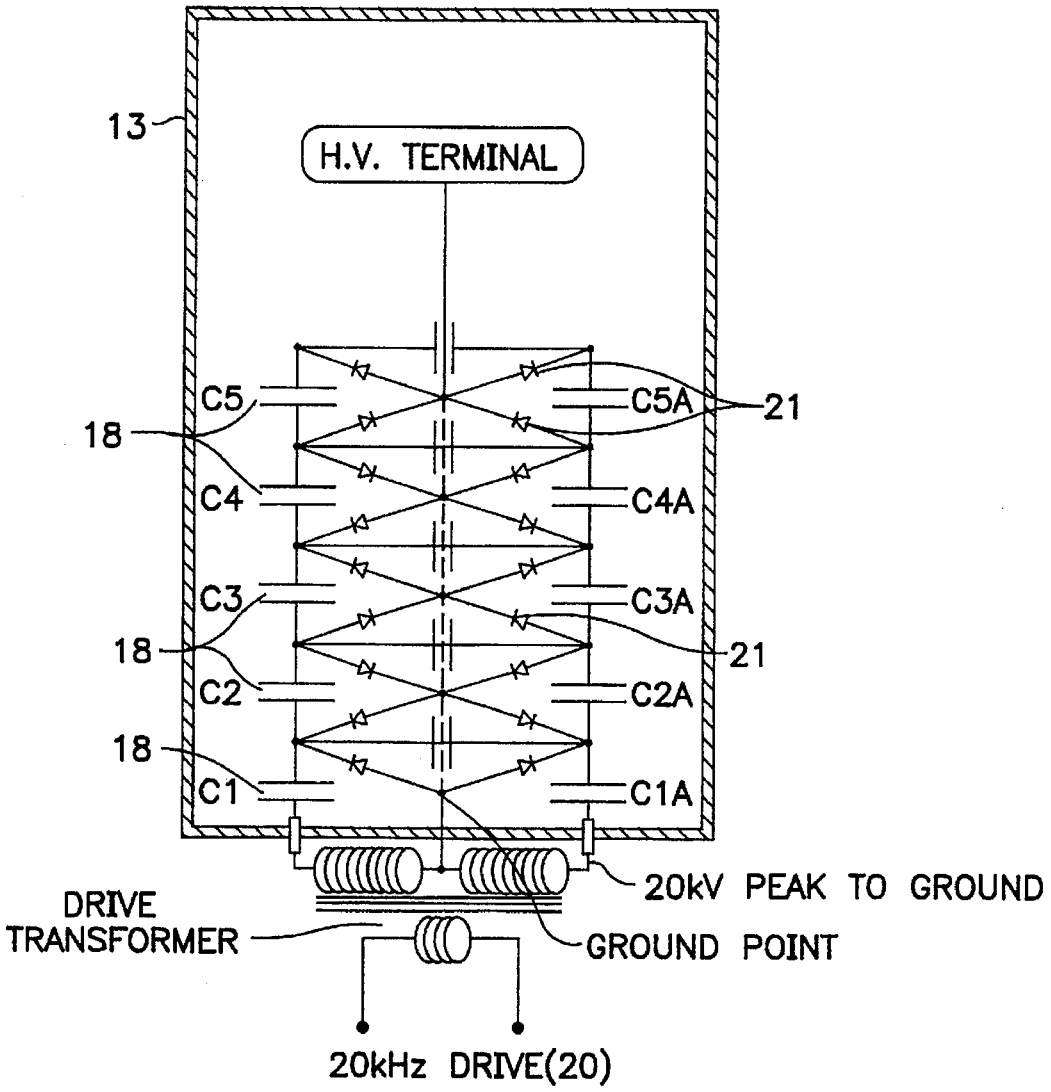
FIG. 3 is an electrical schematic of the high voltage power supply used in the preferred embodiment.

A schematic of the power supply used in the preferred embodiment is shown in FIG. 3. For 150 kV acceleration voltage, the circuit consists of a 4-stage full-wave Cockcroft-Walton rectifier array (18) driven by a 20 kHz oscillator (20). The individual rectifiers (21) are assembled from six commercial silicon diodes potted together and connected in series. A small (10 pF) ceramic capacitor must be placed across each diode to equalize the inverse voltages. Those skilled in the art will recognize that there are many variations to the above design that would also be satisfactory.

It can be seen from FIG. 3 that the a.c drive for the vacuum power supply (20 kHz in the preferred embodiment) is completely symmetrical; when one bank of drive capacitors (18) is providing a positive drive voltage, the other is providing a negative. Thus, there is a central neutral plane along the center of the power supply where the a.c. component of the voltage is always near zero. The acceleration electrodes are connected directly to these points. The dc voltage from electrode to electrode increases by twice the peak voltage applied to each column of the drive capacitors. Thus, in the preferred embodiment, the peak voltage to ground external to the vacuum enclosure is only 18.75 kV—a voltage that is easy to insulate and pass through commercially available pass-through insulators.

Figure 4:
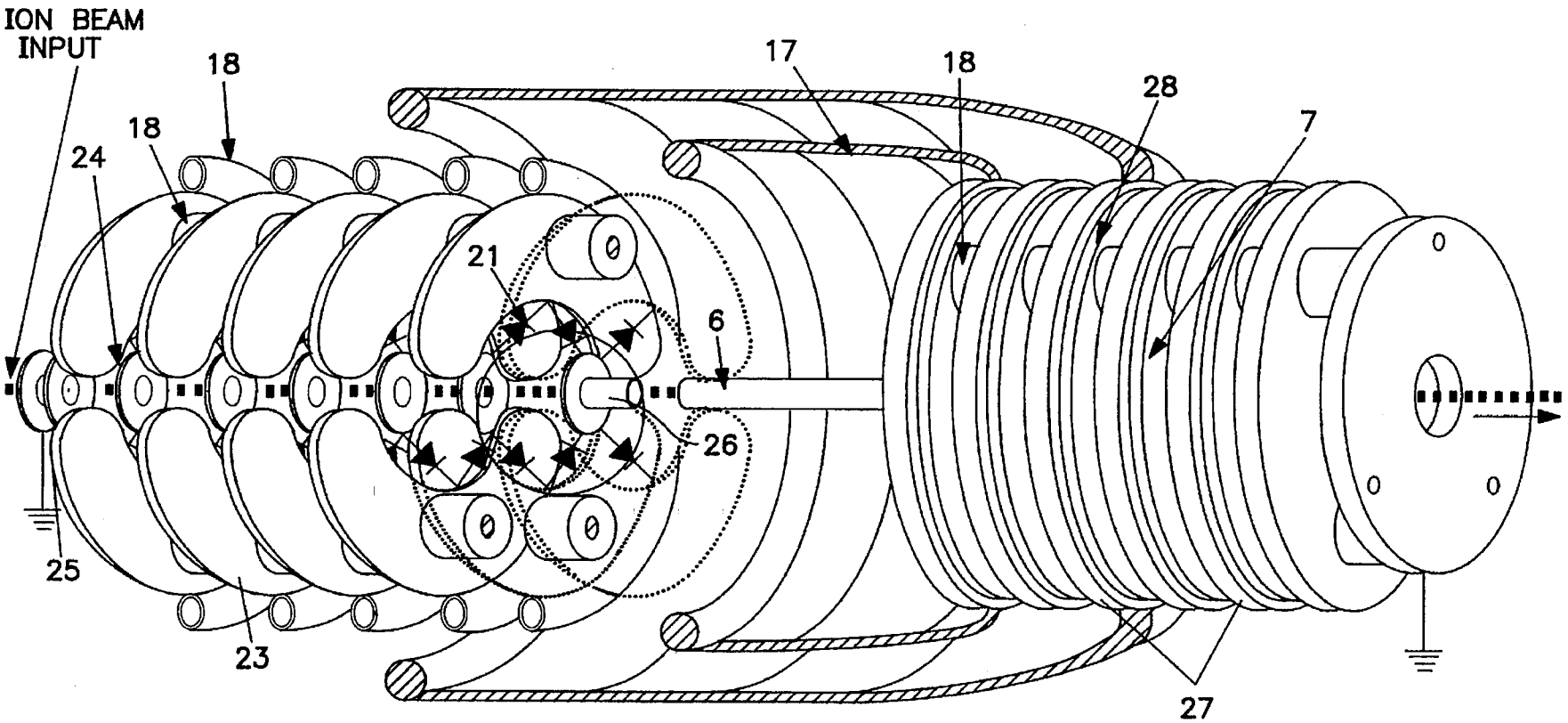
FIG. 4 is a diagram showing the layout of components of the vacuum insulated power supply.

FIG. 4 is a schematic diagram showing the mechanical arrangement of the preferred embodiment of the power supply, electron stripper and second acceleration column. The drive capacitors, (22) support a series of half rings (23). The diode assemblies (21) are connected between the rings in the manner shown in the circuit of FIG. 3. The acceleration tube electrodes (24) are supported in the neutral plane at the junction point of the rectifiers (21). Negative ions from the source are focused through the stripping canal in the terminal by a gridded lens (25). Gas atoms leaving the end of the stripping canal are directed radially by the short pumping impedance (26). The positive ion acceleration tube consists of a series of plates (27) insulated from each other by ceramic cylinders (28). Water cooling channels (29) are bored through each metallic component within the whole accelerator to establish proper voltage distribution. An intermediate electrode (30) connected to the high energy acceleration column at its mid-point prevents total voltages greater than 80 kV between electrodes.

I claim:

1. That method of measuring independently the amount of carbon-14 or tritium atoms in a sample, which method comprises the following steps:

ionizing the sample to form negative ion beams of either carbon or hydrogen, mass analyzing said negative ion beam to transmit only mass-14 ions during carbon analyses or mass-3 ions during tritium analyses, accelerating said transmitted negative ions to a kinetic energy less than 350 keV by means of the first stage of a tandem accelerator, stripping four electrons from a fraction of the accelerated mass-14 ions or two electrons from the mass-3 ions by passage through gas so as to form positive ions, accelerating said positive ions by means of the second stage of said tandem acceleror, electomagnetically analyzing said accelerated positive ions to eliminate ions having other charge and mass, and counting the residual particles in a suitable particle detector.

2. A method in accordance with claim 1 wherein the said stripping gas is helium.

3. A method in accordance with claim 1 wherein the said stripping gas is in the form of a plasma.

4. A method in accordance with claim 1 wherein the said detector individually measures the kinetic energy of each arriving particle without reference to its electric charge.

5. A method in accordance with claim 1 wherein said detector measures the rate of energy loss for each arriving particle as it slows down.

6. Apparatus for detecting the amount of carbon-14 or tritium atoms m a sample, comprising in combination:

an ion source for ionizing the sample and forming a negative ion beam, a mass analyzing system that can be selectively adjusted to transmit only mass-14 or mass-3 ions, a tandem acceleration system for said mass-analyzed negative ions that increases the ion energy to a value less than 350 keV, a gas target for stripping electrons from the accelerated negative ions so as to form positive ions, said tandem, acceleration system accelerating said positive ions, an electromagnetic analyzer that can be adjusted to transmit those thus-accelerated mass-14 positive ions that are triplet charged or those thus-accelerated mass-3 positive ions that are singly charged, and a suitable particle detector.

7. Apparatus in accordance with claim 6 wherein the said stripping gas is helium.

8. Apparatus in accordance with claim 6 wherein the said stripping gas is in the form of a plasma.

9. Apparatus in accordance with claim 6 wherein the said detector individually measures the kinetic energy of each arriving particle without reference to its electric charge.

10. Apparatus in accordance with claim 6, wherein said detector measures the rate of energy loss for each arriving particle as it slows down.

11. Apparatus in accordance with claim 6 including an evacuated environment where the pressure is maintained below $10^{-3}$ Torr, wherein the individual components of the said acceleration system are electrically insulated by enclosure within said evacuated environment.

12. Apparatus in accordance with claim 11 wherein the power supply used in the said acceleration system multiples a low-voltage a.c. signal at ground converting it to a high d.c. voltage using a series connected set of rectifiers in vacuum with the driving potential across each rectifier being derived capacitively in vacuum from the said low-voltage a.c. signal at ground.

13. Apparatus in accordance with claim 11 wherein high resistivity water is used to distribute the voltages used within the said acceleration system.

* * * * *